United States Patent [19]

Bourdon

[11] Patent Number: 4,886,129

[45] Date of Patent: Dec. 12, 1989

[54] WELL DRILLING OPERATION CONTROL PROCEDURE

[75] Inventor: Jean C. Bourdon, Montrouge, France

[73] Assignee: Schlumberger Technology Corporation, Houston, Tex.

[21] Appl. No.: 160,955

[22] Filed: Feb. 26, 1988

[30] Foreign Application Priority Data

Feb. 27, 1987 [FR] France ..... 87 02628

[51] Int. Cl.[4] ..... E21B 47/00

[52] U.S. Cl. ..... 175/40; 175/48

[58] Field of Search ..... 175/27, 40, 48, 50; 73/151

[56] References Cited

U.S. PATENT DOCUMENTS

| | | | |
|---|---|---|---|
| 2,669,871 | 2/1954 | Lubinski | 175/39 |
| 2,670,925 | 3/1954 | Des Champs | 175/40 X |
| 3,881,695 | 5/1975 | Joubert | 175/40 X |
| 4,165,789 | 8/1979 | Rogers | 175/27 |
| 4,627,276 | 12/1986 | Burgess et al. | 73/151 |

FOREIGN PATENT DOCUMENTS

| | | |
|---|---|---|
| 163426 | 12/1985 | . |
| 2518637 | 6/1983 | France . |

OTHER PUBLICATIONS

"Weight/Speed/Penetration" from the Petroleum Engineer, vol. 30, Jan. 1985, pp. 50–52.

*Primary Examiner*—William P. Neuder

*Attorney, Agent, or Firm*—Stephen L. Borst

[57] ABSTRACT

The invention relates to the control of rotary type oil drilling operations. During a drilling test in which the drill string is held against vertical motion at the surface, known as the "drill-off test", an exponential decrease as a function of time, in the weight applied to the drill bit (WOB) is noted as is a threshold where the value of WOB remains constant. From this test the drillability of the formation drilled, the bit wear and the actual value of the weight applied to the bit may be determined.

6 Claims, 3 Drawing Sheets

WELL DRILLING OPERATION CONTROL PROCEDURE

The invention relates to a rotary type oil well drilling operation control procedure involving determination of characteristic parameters. This procedure relies partly on a formation drilling test method which is performed without moving the drill string vertically at the surface, known as the "drill-off test".

Rotary type drilling often poses a number of problems that are difficult for the drilling team to solve, as they can only work with the data and measurements obtained at the surface. These problems are of two types. On one hand, the stability conditions and geometrical characteristics of the newly drilled and therefore uncased part (open part) of the well are generally not known. On the other, there are normally few means available at the surface for quantifying bit wear and following the changing resistance to penetration of the formation during any one phase.

Where the borehole is not of uniform diameter or is inclined from the vertical, the drill string rubs against the sides of the borehole, and this may lead to incomplete transmission of the weight on the bit, due to frictional losses. The word "bit" is used hereafter to refer to both roller cone bits and monocone bits, and generally is the tool which penetrates into the formation and is fixed to the lower end of the drill string. It is also noted that in practice weight transmission losses are rarely nil and are often far from insignificant. As a result, surface measurements of the weight applied to the bit, are often very approximate. The poorer the stability conditions of the open part of the well, the greater the inaccuracy of this datum measured at the surface.

The drill bit wears during drilling operations and has to be replaced in time to prevent it from becoming inefficient when worn and in any case before it fails completely. The latter point is very important, as the economic consequences of fishing up cones from a three-cone bit lost in a well as a result of breakage are always very heavy.

The drill-off test method is already known. This was proposed by A. Lubinski in the January, 1958 edition of "The Petroleum Engineer", in an article entitled "Proposal for Future Tests". This method is a convenient means of determining the variations in the rate of penetration of the bit into the formation (ROP) as a function of the varying weight applied to the bit (WOB), measured at the surface. It was generally recognized that if WOB were increased, ROP rose to a certain value beyond which ROP remained virtually constant. The drill-off test method has so far served only to determine in theory the best parameters to be applied to the bit in order to obtain maximum bit efficiency, and hence the optimum WOB value. This datum was to date the only one obtained from tests of this type.

There is currently no real solution without using sophisticated, costly systems of the measurement while drilling (MWD) type in order to obtain the actual weight applied to the bit.

Further, there is no exact method by which either bit wear or the drillability of the formation may be quantified directly and quickly from simple measurements made at the surface carried out during drilling.

The invention under discussion here proposes a procedure relying partly on the drill-off test method to determine at least one of the following parameters during drilling from measurements made at the surface: parameter a characteristic of the drillability of the formation being drilled and the bit wear, the value of the actual weight applied to the bit and the weight losses applied to the bit due to drill string friction on the well walls.

More exactly, the invention relates to a rotary type well drilling operation control procedure using a drill string fitted with a bit at its lower end and suspended by its upper end, at the surface, from a hook on the drilling rig by which at least one test is carried out during well drilling operations according to the following procedure:

a certain initial weight is applied to the bit and the hook is kept at the same height h throughout the test, drilling is carried out keeping the drill string rotation speed ROT constant throughout the test, The variations in the weight applied to the bit ($WOB_m$) are measured at the surface by means of the measurement of the weight suspended from the hook and recorded as a function of the time t the test lasts. From the $WOB_m$ values measured and recorded as a function of time t, at least one of the following parameters are determined: a parameter representing the drillability of the formation and the bit wear, the value of the actual weight applied to the bit ($WOB_e$) and the value of the loss of weight applied to the bit between the surface and the bit, due to friction between the drill string and the well walls.

Other characteristics and advantages of the invention will become apparent from the description that follows, with reference to the attached drawings, of a non-limitative example of implementation of the procedure.

Figure 1:
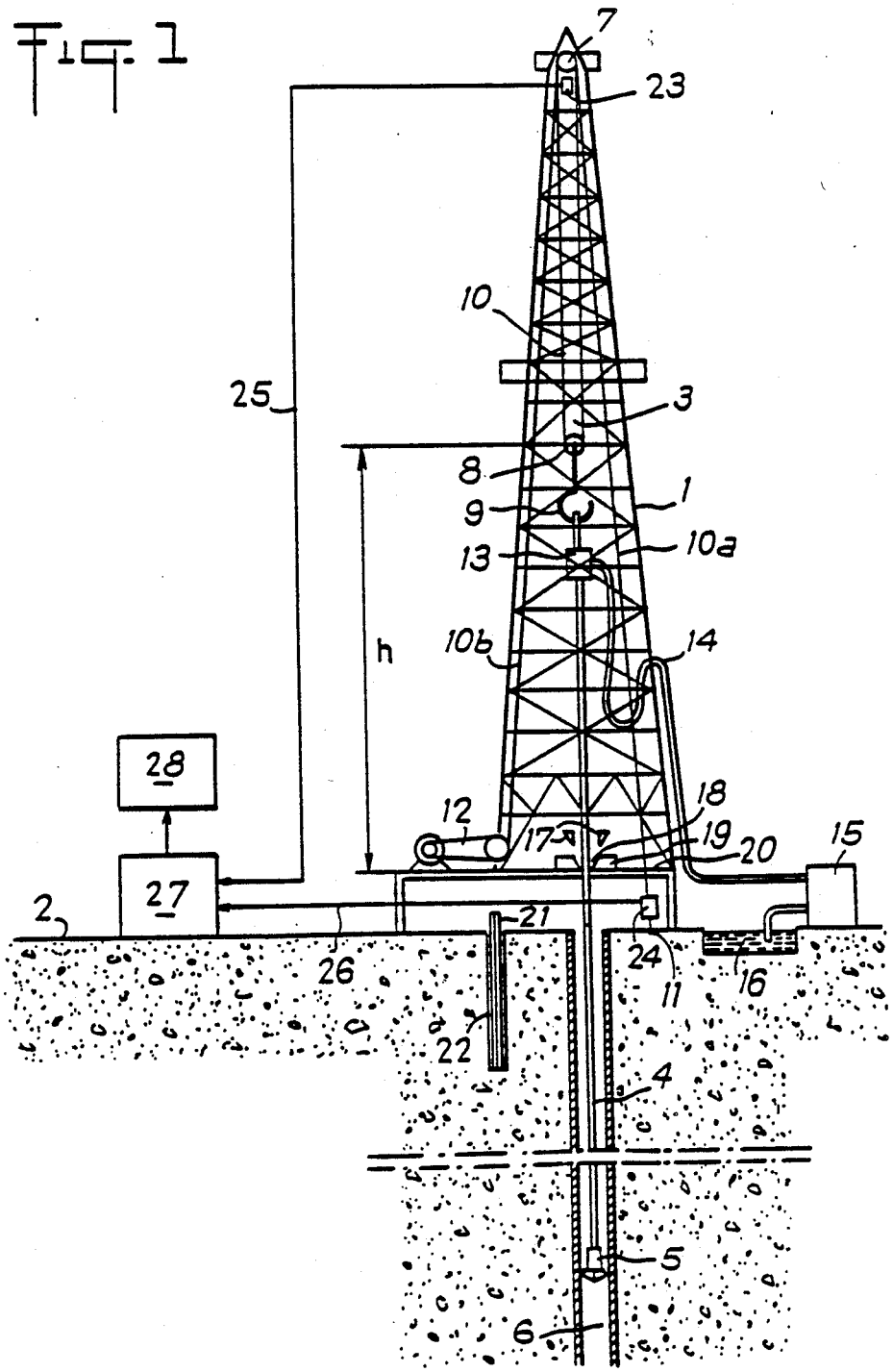
FIG. 1 represents in diagram form, in vertical section, a rotary drilling rig and the well below it.

The rotary drilling rig shown in FIG. 1 comprises a mast 1 rising above the ground 2 and fitted with lifting gear 3 from which is suspended a drill string 4 formed of drill pipes screwed one to another and having at its lower end a bit 5 for the purpose of drilling a well 6. The lifting gear 3 consists of a crown block 7, the axis of which is fixed to the top of the mast 1, a vertically travelling block 8, to which is attached a hook 9, a cable 10 passing round blocks 7 and 8 and forming, from crown block 7, on one hand a dead line **10*a* anchored to a fixed point 11 and on the other an active line 10*b* which winds round the drum of a winch 12**.

The drill string 4 is suspended from hook 9 by means of a swivel 13 linked by a hose 14 to a mud pump 15, which permits injection into the well 6, via the hollow pipes of the string 4, of drilling mud from a mud pit 16, which pit may be fed with surplus mud from the well 6. By this means, by turning the lifting gear 3 by means of winch 12, the drill string 4 may be brought up, the pipes being successively removed from the well 6 and unscrewed in order to remove the bit 5, or the drill string 4 may be lowered, successively screwing back its component pipes, in order to take the bit back down to the bottom of the well. These drill pipe raising and lowering operations require the drill string 4 to be temporarily unhooked from the lifting gear 3; the former is then supported by blocking it with wedges 17 in a conical recess 18 in the rotating table 19 mounted on a platform 20 through which the drill string passes.

During drilling periods, the drill string 4 is driven in a rotary motion by means of a kelly 21 fitted to its upper end. Between such periods the kelly is stored in a pipe sleeve 22 in the ground.

The variations in the height h of travelling block 8 during these drill string 4 raising operations are measured by means of a sensor 23. In this example, this is an angle of rotation sensor coupled to the faster pulley of crown block 7 (the pulley from which active line 10*b* leaves). This sensor gives at each moment the magnitude and direction of rotation of that pulley, from which the value and direction of linear travel of cable 10 may easily be worked out then, taking into account the number of lines between blocks 7 and 8, the value and direction of travel of block 8 and, subsequently, its height h.

Besides its height h, the load applied to hook 9 of the travelling block 8 is measured; this corresponds fairly closely to the weight of the drill string 4 in the drilling mud in the well. This load varies with the number of pipes in the string. This measurement is made by means of a strain gauge 24 inserted into dead line 10*a* of cable 10 to measure its tension. By multiplying the value given by this gauge by the number of lines between blocks 7 and 8, the load on hook 9 of block 8 is obtained.

Sensors 23 and 24 are connected by lines 25 and 26 to a processing unit 27 which processes the measurement signals and which incorporates a clock. A recorder 28 is connected to the processing unit 27, which is preferably a computer.

The parameters measured necessary for the implementation of the invention are the weight suspended from the hook 9, the height of the travelling block supporting this hook and the time spent on drilling the formation as supplied by the clock incorporated into the computer 27. The parameters are regularly recorded at a frequency of 5 Hz and immediately digitized, i.e. converted into binary values directly usable by the computer. The recordings of these values are indexed in time.

The drill-off test method is then put into use, directly during the drilling operation. To do this the driller blocks the brake on winch 12 which controls the downward travel of hook 9. This has the effect of stopping apparent drilling at the surface, while the bit continues to advance at the bottom of the well due to elastic extension of the drill string. A transfer of weight then takes place between the bottom of the well and the surface, the loss of weight at the bit being apparently seen as an increase in the weight on the hook read at the surface. The variations of the weight on the bit $WOB_m$ are then recorded as a function of time. The test ends when the variation of the weight on the hook ceases to be significant or when the amplitude of the variation is deemed satisfactory in order to be interpreted. The interpretation relates to the characteristic of the decrease of weight on the bit read at the surface during this test. An analytical model, given below, shows that this decrease is in most cases exponential. The gradient of this decrease is a characteristic common to the formation drilled and the bit used.

Moreover, it is noted in most cases that the weight on the bit, as determined from the load on the hook, tends towards a threshold value, as a function of time, other than zero. In this case the exponential characteristic of the decrease is true only if the origin of the reference is moved so that the curve tends towards the threshold value.

Figure 2:
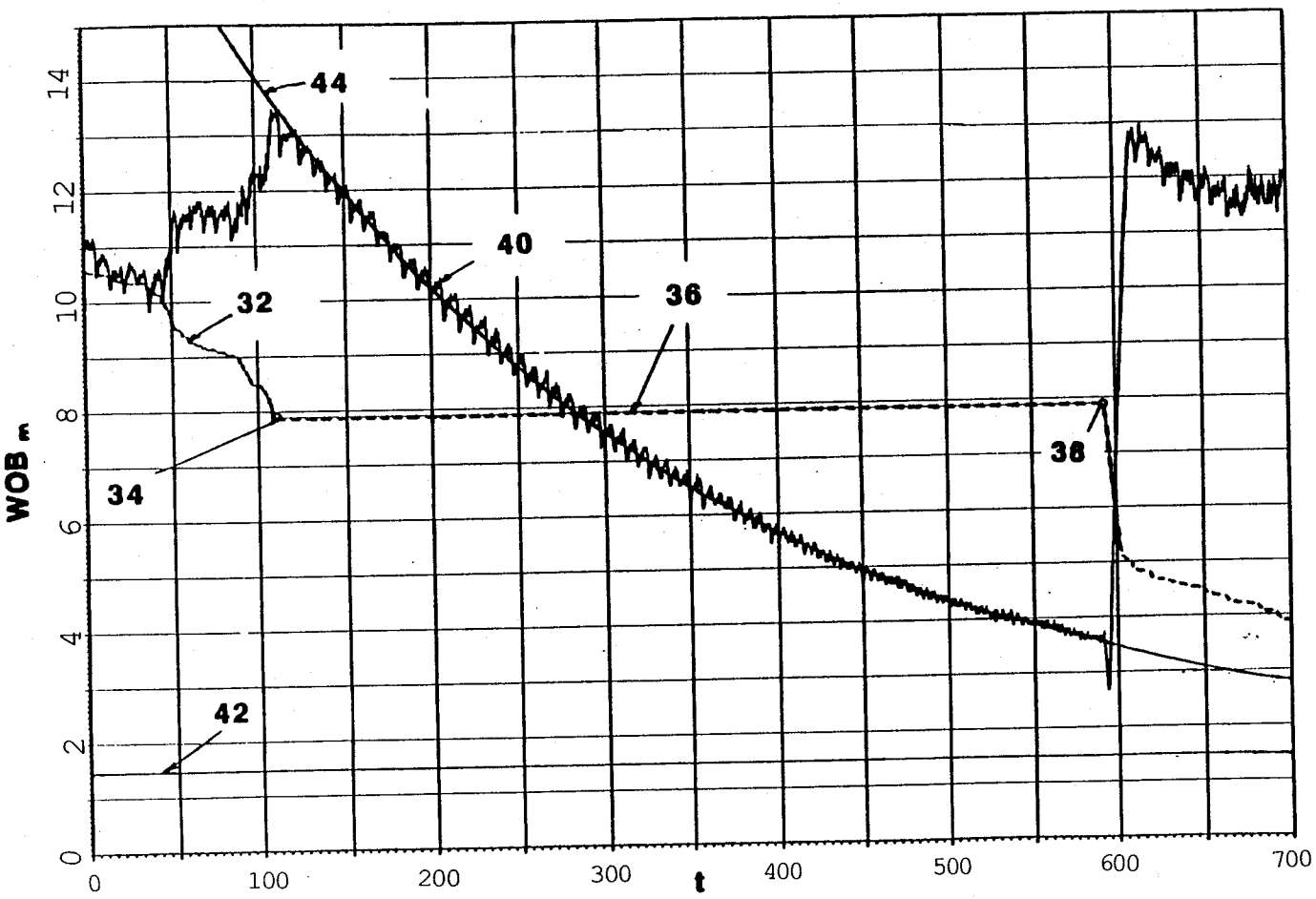
FIG. 2 shows a recording of the values of $WOB_m$ measured as a function of time, partly applying the drill-off test method, and a comparison with a theoretical exponential decrease curve.

During the test the values that directly influence the drilling efficiency are held approximately constant by the driller in charge of the winch. These parameters are the rate of bit turn and the system hydraulics, principally the drilling mud composition and flow rate. The most important variable parameter in the test is the weight on the bit measured at the surface. This parameter is worked out from the weight on the hook measured by means of gauge 24 placed on dead line 10*a* of the block line. This gauge gives an electrical signal proportional to the load on the dead line, therefore proportional to the weight hanging from the hook. The electrical signal is then converted into weight on the hook after each measurement by computer 27. The weight on the bit measured at the surface is given at any time when drilling is in progress by the difference between the total weight of the drill string driven in rotary motion in the well mud, when the bit is not touching the bottom, and the same weight when the bit is applied to the bottom in the course of drilling. The drill string rate of turn is measured directly by means of a sensor located on a turning part of the rotating table 19 which, linked to a frequency meter, gives a value subsequently converted into rate of turn by computer 27. In the course of drilling the travelling block 8 descends, controlled by the driller acting on the winch 12 brake while striving to keep the weight on the bit 5 constant. This travelling block, supporting the drill string 4 by means of hook 9 and swivel 13, is then checked in its descent. The brake is then kept on. Consequently the height h of the travelling block 8 (and hence of hook 9) is seen to be invariably constant throughout the test. Curve 32 on FIG. 2 represents the height h of block 8 (or hook 9) as a function of time. The start of a test may be detected by the first point 34 of a segment 36 of constant block height and the end is indicated by the last point 38 of that segment. The invention method may be applied automatically. In this case the beginning and end of the test, corresponding to points 34 and 38, are detected automatically. On FIG. 2, curve 40 represents the values measured at the surface of the weight on the bit WOBm (measured in tons) as a function of time t (measured in seconds). Two validations are performed on this test to accept or reject the data and pursue interpretation.

The first of these checks that the test lasts longer than 45 seconds in order to eliminate all partial tests during drilling through particularly difficult sections. This is the case for example when the driller is doing stepped drilling, when block 8 is successively released then checked for several seconds.

The second check concerns the amplitude of decrease of the weight on the bit WOB during the test. The test quality criterion calls for the greatest possible amplitude of weight on the bit. It is therefore agreed that a test will only be accepted if the amplitude of weight measured during the test is greater than a certain value, for example 60,000 newtons.

Having measured and recorded the experimental test data, the next step is to interpret them. It has been shown that the rate of bit penetration ROP may generally be considered as being proportional to the actual weight applied to the bit $WOB_e$ and a linear function of the rate of turn f(ROT). The equation may therefore be written thus:

$$ROP = a(WOB_e)[f(ROT)]$$

a being a value characteristic of the efficiency of drilling which depends on the drillability of the formation and the efficiency of the bit (the wear for a given bit).

During a test while the hook is kept fixed at the surface, the weight on the bit is related to the bit penetration into the formation by the elasticity of the drill string.

Calling E: Young's modulus of the drill string steel,
S: section of elastic part of drill string,
L: length of elastic part of drill string (mainly the pipes alone without the drill collar),
t: time elapsed since start of test,
ROT: rate of turn of drill string The following may be written:

$$Delta(WOB_e) = (E)(S)[(Delta\ L)/L]$$

thus: Delta $(WOB_e)$/Delta $t = -[(E)(S)/L]a(WOB_e)[f(ROT)]$ where Delta (WOB), Delta L and Delta t represent the variations of WOB, L and t respectively. Integrating the latter expression thus gives $WOB_e$ as a function of time during the test:

$$WOB_e = WOB_i exp[-\{(E)(S)/L\}(a)[f(ROT)](t)]$$

$WOB_i$ being the weight on the bit calculated with $t=0$ and corresponding to point 34 on FIG. 2. As the results of the numerous experiments conducted have shown, the weight on the bit does not fall to nil but stabilizes at a finite positive value called the "threshold". This "threshold" value is indicated by reference 42 on FIG. 2 and corresponds to 1.5 tons in the case of this test. It may therefore be written that the value of $WOB_m$ measured at the surface is equal to the actual value $WOB_e$ plus the threshold value $$WOB_m = WOB_e + threshold$$

or $$WOB_m = threshold + WOB_i exp[-[(E)(S)/L](a).[f(ROT)](t)] \quad (1)$$

It will be seen that in this expression the value of the weight on the bit measured at the surface $WOB_m$ decreases exponentially over time, and depends on parameter a and the threshold value. The values of (E)(S)/L and f(ROT) are constant and assumed to be known. If they were not known then the absolute value of a would not be determinable and only the variations of a or its relative value would be known. According to this invention the values of the threshold and parameter a (or its relative value) are determined.

The threshold value could, of course, be determined experimentally by recording the $WOB_m$ values over a sufficiently long period for there to be no further decrease and for them to reach a more or less constant value, this being the threshold value. In practice, it is not necessary to continue the test that long, since as soon as the exponential decrease is known with sufficient accuracy, the values of a, threshold and $WOB_i$ can be determined mathematically by comparing the experimental curve 40 with the theoretical curve 44 obtained by equation (1) for different values of a, threshold and $WOB_i$, until theoretical curve 44 has the same shape as experimental curve 40.

In practice, the $WOB_m$ values measured are converted into logarithms. The values of log $WOB_m$ should in theory, according to equation (1), align along a straight line, the equation of which is determined by the least error squares method. Other methods, known as analytical methods, may be used.

The definition should now be given of what the actual weight on the bit $WOB_e$ and the threshold value represent in terms of quality. The effective weight $WOB_e$ represents the actual force with which the bit bears on the well bottom, which in fact represents the effective force for the rate of penetration. This value is deduced from the value of the weight on the bit measured at the surface $WOB_m$ and the threshold value determined by the test and is given by the expression: $WOB_e = WOB_m - threshold$.

The simple interpretation attached to this equation is that any weight on the bit measured at the surface which does not directly create any penetration is lost in friction along the drill string. This lost weight corresponds to the threshold value. The effective or actual weight can therefore be calculated immediately. From his knowledge of the threshold value, the driller can at any time ascertain the absolute value of the longitudinal force necessary to overcome friction in the open part of the well. This information is of very great value in characterizing borehole wall quality and the general form of the open part of the well. Previously it has generally been subjectively estimated. Implementation of the method of this invention, if practiced just before bringing up the drill string for example, enables estimation of potential problems that may be encountered while bringing up the drill string.

Parameter a characterizes the efficiency of drilling. Its value increases with the drillability of the formation and decreases with bit wear. This is an important parameter for the driller, who can now follow its changes during drilling.

There are two cases to be considered:

On one hand, if a development well is being drilled with a known lithological structure. The changing efficiency of the bit can then be effectively monitored as the well is drilled. Coefficient a may be decorrelated for the drillability of the formation, the latter being known and quantified as a hardness index (in the widest sense). This indicator may be used by the driller in deciding, for example, when to bring up a worn bit. This monitoring is all the more efficient as the drill bit wears significantly, which is the case, for example, with all milled-tooth bits.

On the other hand, if a well of unknown lithological characteristics is being drilled, a test performed according to the invention is carried out as soon as drilling recommences with a new bit in order to determine the values of parameters a and the threshold. The variations in coefficient a can then readily be monitored as the well is drilled so as to provide a relative characterization of the changing drillability of the formation. Lower bit tooth wear gradients are indicative of the hardness of the bit, as for example, with all tungsten-carbide insert bits.

Figure 3:
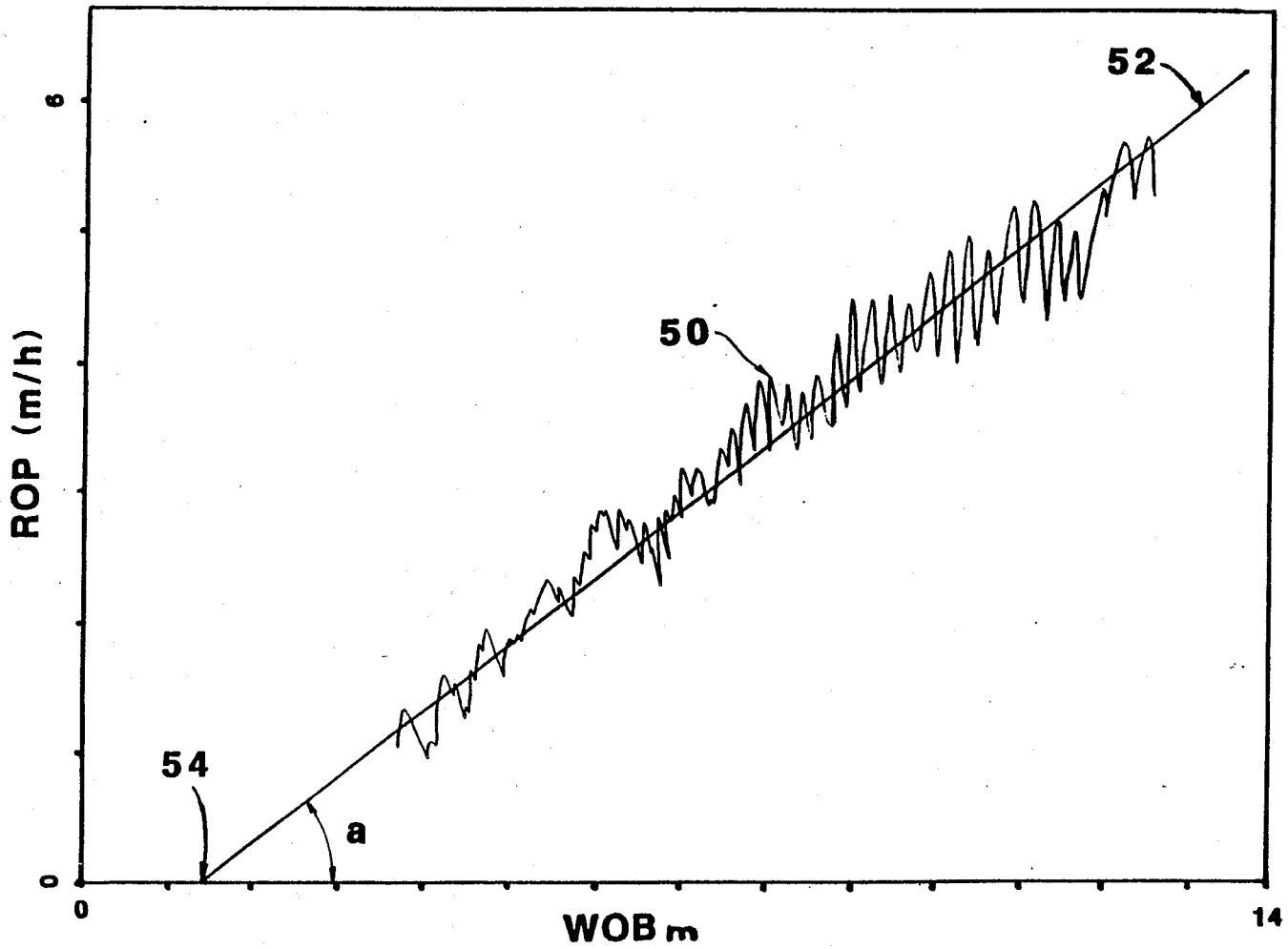
FIG. 3 represents the variations in the drill string penetration rate (ROP) as a function of WOB during a drill-off test.

The graph in FIG. 3 can usefully be used to monitor the changes in parameter a. On this graph curves 50 and 52 are obtained experimentally and theoretically respectively, and represent the variations in the rate of bit penetration ROP, in meters per hour, as a function of the weight on the bit measured at the surface $WOB_m$ expressed in tons.

Curve 50 is obtained by combining two sets of data: on one hand, changes in $WOB_m$ over time (FIG. 2) and on the other, the rate of bit penetration ROP over time (calculated from the drill string extension, with the Young's modulus of the steel, the length of the drill string and the longitudinal force acting on that length being known). Since the movement of the two parameters $WOB_m$ and ROP are known for each parameter in relation to the same variable, time, experimental curve ROP can be deduced immediately as a function of $WOB_m$.

As to theoretical curve 52, it may be shown by means of the following equation that ROP is a function of $WOB_m$:

$$ROP = k(WOB_m - \text{threshold})(L/ES)$$

$$\text{with } k = a[f(ROT)](ES/L).$$

It will be seen that this curve 52 is a straight line having a gradient equal to the product of a[f(ROT)] and that $WOB_m$=the threshold if ROP=0. This value of $WOB_m$ is indicated by reference 54 on FIG. 3. Since it was assumed that the rate of drill string turn was kept constant, the variations in the gradient of straight line 52 depend only on the changes in parameter a. The driller can therefore, either on the same graph or by repetition of the test according to the invention, obtain several successive graphs, monitor the changing drillability of the formation or formations encountered (assuming the bit does not wear) or mechanical bit failure (during a single test) or bit wear over several tests on a formation the drillability of which is assumed to be constant. The value of a, and hence of the straight line gradient, decreases with the hardness of the formation and with bit wear. Moreover, if curve 50 is not a straight line on average, in a single test, this means that during this test either the lithology of the formation is not homogeneous or the bit has worn quickly. By this means it is possible to detect mechanical bit failure, such as the loss of one cone on a three-cone bit.

It is also possible from FIG. 3 to predict the rate of bit penetration after the test, as a function of the weight $WOB_m$ applied to the bit measured at the surface.

I claim:

1. A test procedure carried out during well drilling operations for monitoring rotary type well (6) drilling operations, by means of a drill string (4) fitted at its lower end with a bit (5) and suspended by its upper end, at the surface, from a hook (9) from the drill rig (1) comprising:

applying a certain initial weight to the bit (5);

keeping the hook (9) att the same height h throughout the test;

maintaining the rate of turn ROT of the drill string (4) more or less constant throughout the test;

measuring variations in the weight applied to the bit ($WOB_m$) at the surface by means of the measurement of the weight suspended from the hook (9) and recording said measurements as a function of the time, t, wherein the values of $WOB_m$ decrease roughly exponentially as a function of time t;

from said exponential function, determining, for a time considered as infinite, a threshold value representing the value of the loss of weight applied to the bit between the surface and the bit; and determining from the values of $WOB_m$ measured and recorded as a function of time t, at least one of the parameters selected from the group consisting of: a parameter, a, representing the drillability of the formation and the bit wear, and the value of the actual weight applied to the bit ($WOB_e$), said value of the actual weight applied to the bit being derived from the expression $WOB_e = WOB_m$ − threshold.

2. The procedure according to claim 1 further comprising the step of determining the value of the coefficient of the exponential function as a linear function of parameter, a, representing the drillability of the formation and the bit wear.

3. The procedure according to claim 1, further including the steps or: determining the drill string extension during the test; from the actual weight applied to the bit ($WOB_e$), determining the rate of bit penetration (ROP); and from the values of $WOB_m$ and ROP obtained as a function of time t, determining the variations in ROP as a function of $WOB_m$.

4. The procedure according to claim 3, wherein several successive tests are performed during drilling operations and further including the step of monitoring changes in parameter, a, from one test to another.

5. The procedure according to claim 1 further comprising the steps of assuming the lithology of the formation drilled is invariable; and monitoring the changing value of parameter, a, as an indication of changing bit wear.

6. Procedure according to claim 1, 2, 3 or 4, characterized in that, the bit wear being regarded as negligible, the changing drillability of the formation is monitored by monitoring the changing value of parameter a.

* * * * *